US005671705A

United States Patent [19]

Matsumoto et al.

[11] Patent Number: 5,671,705

[45] Date of Patent: Sep. 30, 1997

[54] CONTROL SYSTEM FOR TWO OPPOSED SOLENOID-TYPE ELECTROMAGNETIC VALVE

[75] Inventors: Yasushi Matsumoto; Takashi Sugai; Shigeru Yanagisawa, all of Wako, Japan

[73] Assignee: Honda Giken Kogyo K.K. (Honda Motor Co., Ltd. in English), Tokyo, Japan

[21] Appl. No.: 733,091

[22] Filed: Oct. 16, 1996

Related U.S. Application Data

[63] Continuation of Ser. No. 448,676, May 24, 1995, abandoned.

[30] Foreign Application Priority Data

Nov. 4, 1994 [JP] Japan ..... 6-295895

[51] Int. Cl.[6] ..... F01L 9/04

[52] U.S. Cl. ..... 123/90.11; 123/129.01

[58] Field of Search ..... 123/901.1; 251/129.01, 251/129.05, 129.07

[56] References Cited

U.S. PATENT DOCUMENTS

| | | | |
|---|---|---|---|
| 4,515,343 | 5/1985 | Pischinger et al. | 123/90.11 |
| 4,544,986 | 10/1985 | Buchl | 123/90.11 |
| 4,777,915 | 10/1988 | Bonvallet | 123/90.11 |
| 4,841,923 | 6/1989 | Buchl | 123/90.11 |
| 4,846,120 | 7/1989 | Buchl | 123/90.11 |
| 4,955,334 | 9/1990 | Kawamura | 123/90.11 |
| 5,074,259 | 12/1991 | Pusic | 123/90.11 |
| 5,095,856 | 3/1992 | Kawamura | 123/90.11 |
| 5,131,624 | 7/1992 | Kreuter et al. | 123/90.11 |
| 5,222,714 | 6/1993 | Morinigo et al. | 123/90.11 |

FOREIGN PATENT DOCUMENTS 6-17642 3/1994 Japan .

*Primary Examiner*—Weilun Lo

*Attorney, Agent, or Firm*—Arthur L. Lessler

[57] ABSTRACT

A control system for an electromagnetic valve having a valve element, a pair of solenoids opposed to each other and disposed to drive the valve element in respective directions opposite to each other and between a first extreme position and a second extreme position, and a spring interposed between the solenoids, for biasing the valve element toward a neutral position intermediate between the first and second extreme positions. The solenoids are controlled such that when the valve element is to start moving from one of the first and second extreme positions toward the other extreme position, energization of a corresponding one of the solenoids is terminated, and energization of the other solenoid is started when a predetermined delay time period elapses from the termination of the corresponding one solenoid. The solenoids are also controlled such that they are both energized over a predetermined lap time period during movement of the valve element from one of the first and second extreme positions toward the other extreme position.

14 Claims, 4 Drawing Sheets

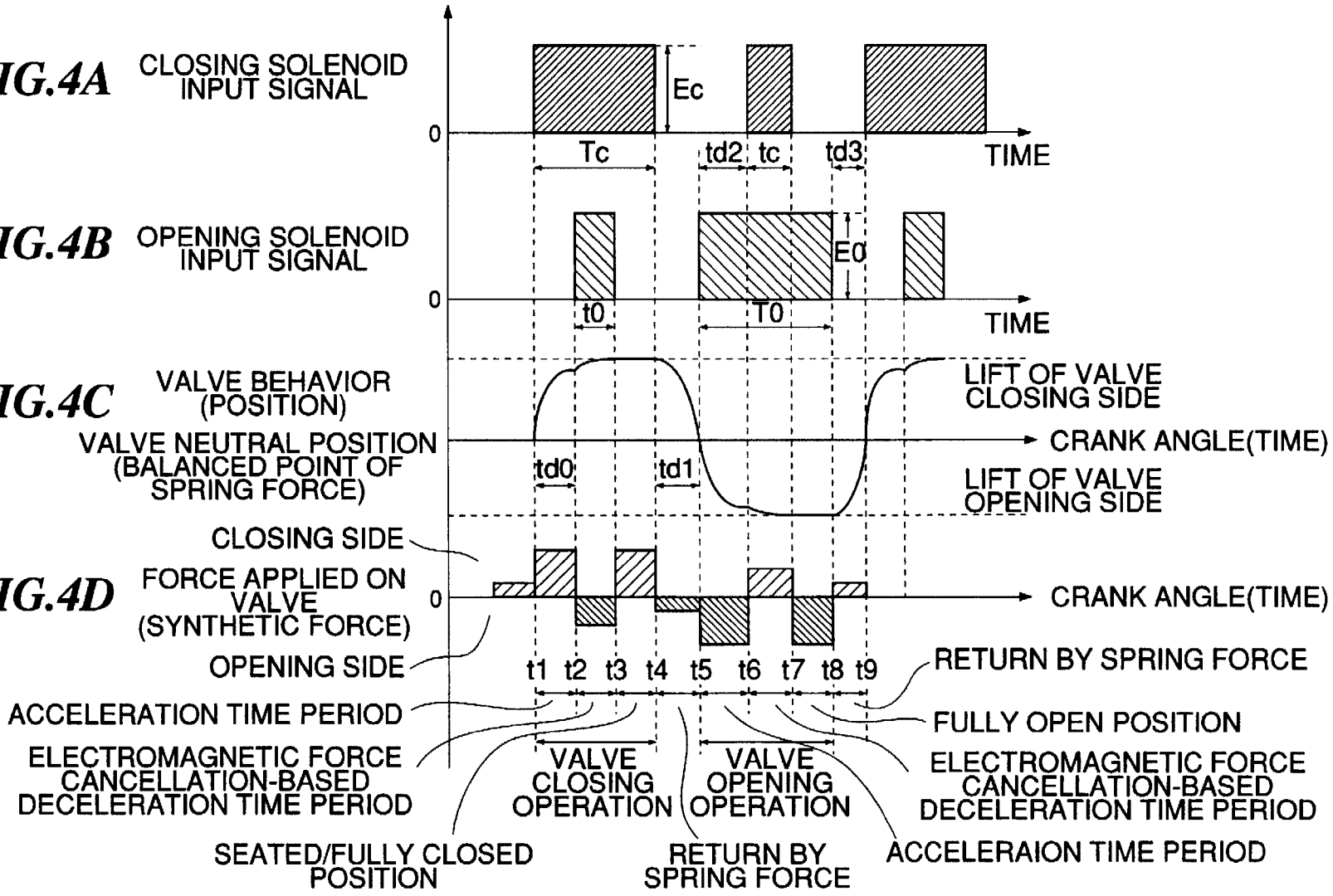
FIG.4A
CLOSING SOLENOID INPUT SIGNAL
TIME
0
Tc
Ec
td2
tc
td3
FIG.4B
OPENING SOLENOID INPUT SIGNAL
TIME
0
t0
T0
E0
FIG.4C
VALVE BEHAVIOR (POSITION)
VALVE NEUTRAL POSITION (BALANCED POINT OF SPRING FORCE)
LIFT OF VALVE CLOSING SIDE
CRANK ANGLE(TIME)
LIFT OF VALVE OPENING SIDE
td0
td1
FIG.4D
FORCE APPLIED ON VALVE (SYNTHETIC FORCE)
CLOSING SIDE
OPENING SIDE
CRANK ANGLE(TIME)
0
t1 t2 t3 t4 t5 t6 t7 t8 t9
RETURN BY SPRING FORCE
FULLY OPEN POSITION
ELECTROMAGNETIC FORCE CANCELLATION-BASED DECELERATION TIME PERIOD
ACCELERAION TIME PERIOD
VALVE OPENING OPERATION
RETURN BY SPRING FORCE
VALVE CLOSING OPERATION
SEATED/FULLY CLOSED POSITION
ACCELERATION TIME PERIOD
ELECTROMAGNETIC FORCE CANCELLATION-BASED DECELERATION TIME PERIOD

CONTROL SYSTEM FOR TWO OPPOSED SOLENOID-TYPE ELECTROMAGNETIC VALVE

This application is a continuation of application Ser. No. 08/448,676, filed May 24, 1995, now abandoned.

BACKGROUND OF THE INVENTION

1. Field of the Invention

This invention relates to a control system for an electromagnetic valve driven by two solenoids which are opposed to each other.

2. Prior Art

There are conventionally known control systems for intake and exhaust valves of internal combustion engines, which drive the intake and exhaust valves by electromagnetic means. For example, a control system of this kind has been proposed by Japanese Patent Publication (Kokoku) No. 6-17642, which employs intake and exhaust valves each formed by a so-called two opposed solenoid-type electromagnetic valve which comprises two solenoids opposed to each other and a spring, wherein the valve element of the intake or exhaust valve is driven by the opposed solenoids.

In such control systems for intake and exhaust valves formed by electromagnetic valves, it is necessary to carry out deceleration control in order to gently stop the valve element at a fully closed position and a fully open position. To this end, according to the control system proposed by Japanese Patent Publication No. 6-17642, the moving speed of the valve element is controlled to decelerate by controlling supply of driving current to the solenoids. More specifically, one of the solenoids is deenergized and at the same time the other solenoid is energized at a predetermined deceleration-starting point during a valve closing stroke or a valve opening stroke of the valve element. As a result, an electromagnetic force applied to the valve element drastically changes, resulting in a failure to finely control the moving speed of the valve element. Particularly, due to variations in mechanical characteristics of the valve element such as mass and frictional coefficient, precise deceleration control cannot be achieved. Further, in the proposed control system, the biasing force of the spring is not effectively utilized. Therefore, the proposed control system still remains to be improved.

On the other hand, various conventional control systems using electromagnetic means for driving intake and exhaust valves have been proposed, which have buffer mechanisms utilizing oil hydraulic pressure, pneumatic pressure, resilient members, etc. However, these proposed buffer mechanisms are disadvantageous in that they are complicated in structure.

SUMMARY OF THE INVENTION

It is an object of the invention to provide a control system for two opposed solenoid-type electromagnetic valves, which effectively utilizes the biasing force of the spring in controlling closing and opening movement of the valve element.

Another object of the invention is to provide a control system for two opposed solenoid-type electromagnetic valves, which is capable of performing smooth deceleration control of the valve element without using a buffer mechanism.

According to a first aspect of the invention, there is provided a control system for an electromagnetic valve having a valve element, a pair of solenoids opposed to each other and disposed to drive the valve element in respective directions opposite to each other and between a first extreme position and a second extreme position, and spring means interposed between the solenoids, for biasing the valve element toward a neutral position intermediate between the first and second extreme positions, the control system comprising:

control means for controlling the solenoids in a manner such that when the valve element is to start moving from one of the first and second extreme positions toward the other extreme position, energization of a corresponding one of the solenoids is terminated, and energization of the other solenoid is started when a predetermined delay time period elapses from the termination of the corresponding one solenoid.

Preferably, the predetermined delay time period is set to at least a time period from the time the energization of the corresponding one solenoid is terminated to the time acceleration of the valve element attributable to the spring means becomes almost zero.

Also preferably, the control means carries out energization of the corresponding one solenoid over a first predetermined time period, and carries out energization of the other solenoid over a second time period shorter than the first predetermined time period, within the first predetermined time period.

Advantageously, the first and second extreme positions are a fully closed position of the valve element and a fully open position thereof, respectively.

In a preferred embodiment of the invention, the electromagnetic valve is an intake valve for opening and closing an intake port of an internal combustion engine.

In another preferred embodiment of the invention, the electromagnetic valve is an exhaust valve for opening and closing an exhaust port of an internal combustion engine.

According to a second aspect of the invention, the control system comprises control means for controlling the solenoids in a manner such that the solenoids are both energized over a predetermined lap time period during movement of the valve element from one of the first and second extreme positions toward the other extreme position.

Preferably, during the movement of the one extreme position toward the other extreme position, the control means carries out energization of one of the solenoids over a first predetermined time period, and carries out energization of the other solenoid over a second predetermined time period as the predetermined lap time period, which is shorter than the first predetermined time period, within the first predetermined time period.

Also preferably, the control means starts the energization of the other solenoid upon lapse of a third predetermined time period after the energization of the one solenoid is started.

More preferably, the control system includes operating condition-detecting means for detecting operating conditions of the internal combustion engine, and wherein the first to third predetermined time periods are set according to the operating conditions of the internal combustion engine detected by the operating condition-detecting means.

The above and other objects, features and advantages of the invention will become more apparent from the following detailed description taken in conjunction with the accompanying drawings.

BRIEF DESCRIPTION OF THE DRAWINGS

FIG. 4 is a timing chart useful in explaining the valve operation control.

DETAILED DESCRIPTION

The invention will now be described in detail with reference to the drawings showing an embodiment thereof.

Figure 1:
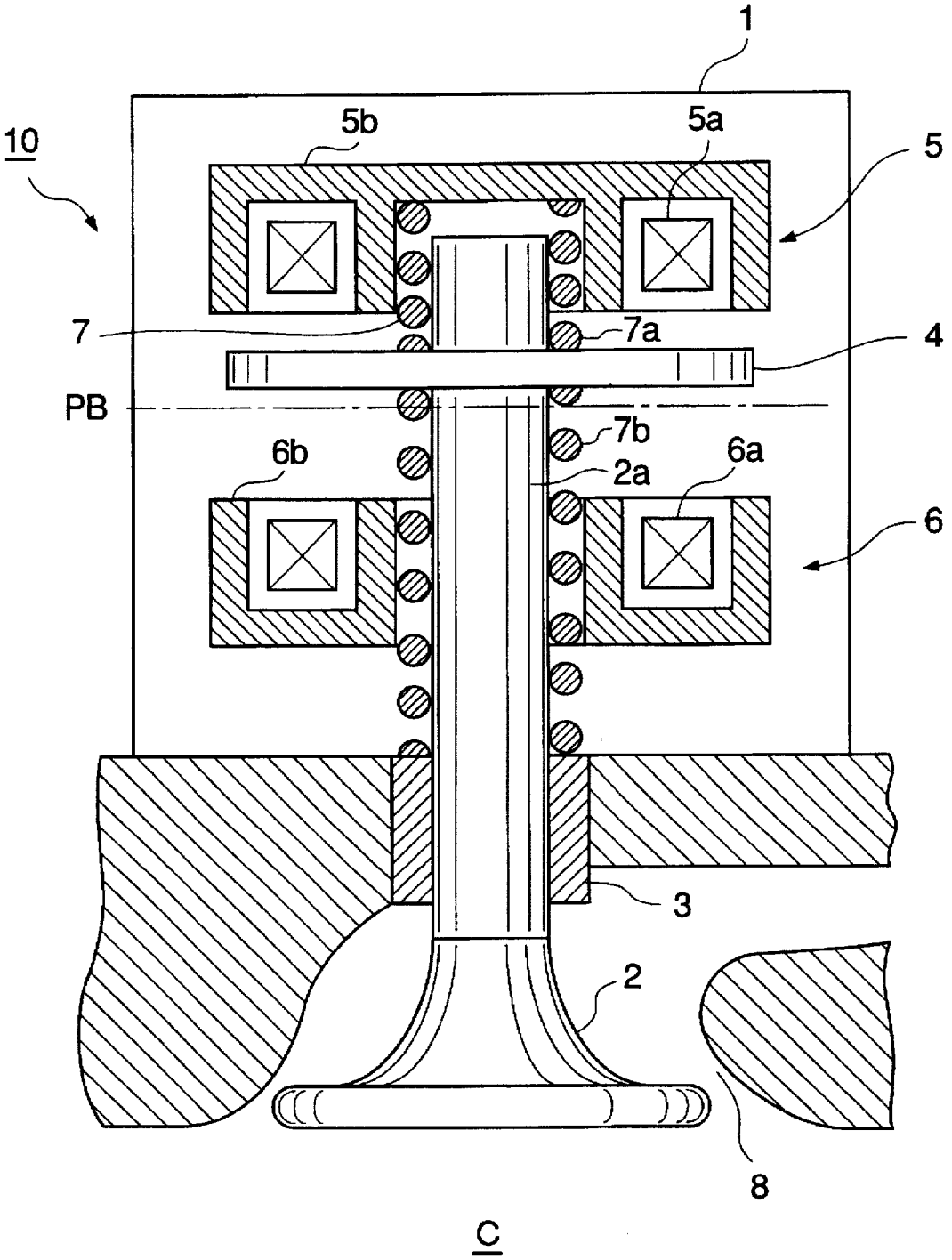
FIG. 1 is a longitudinal sectional view showing the construction of a two opposed solenoid-type electromagnetic valve employed in a control system according to an embodiment of the invention.

Referring first to FIG. 1, there is illustrated the construction of an electromagnetic valve 10 which is driven by two opposed solenoids employed in a control system according to an embodiment of the invention. The electromagnetic valve 10 is comprised of a valve element 2 which has a valve stem 2*a* with a magnetic element 4 as an armature secured thereon, and a valve driving section 1 for driving the valve element 2. The electromagnetic valve 10 is mounted in a head of a cylinder block of an internal combustion engine at a location above a combustion chamber C in such a fashion that the valve element 2 is slidably fitted through a valve guide 3, for opening and closing an intake port (or exhaust port) 8 opening into the combustion chamber C.

The valve driving section 1 is comprised of two solenoids (electromagnets) which are opposed to each other in the longitudinal direction, i.e. a closing solenoid 5 for biasing the valve element 2 in a valve closing direction and an opening solenoid 6 for biasing the valve element 2 in a valve opening direction, and a spring 7 interposed between the closing solenoid 5 and the valve guide 3. The closing solenoid 5 is comprised of a coil 5*a* and a core member 5*b*, while the opening solenoid 6 is comprised of a coil 6*a* and a core member 6*b*. The spring 7 is comprised of a first coiled spring 7*a* interposed between the core member 5*b* and the armature 4, and a second coiled spring 7*b* interposed between the armature 4 and the core member 6*b*, the first and second springs 7*a*, 7*b* being disposed such that the biasing force of the spring 7 becomes zero when the armature 4 is positioned at a balanced or neutral position BP. The spring 7 acts to bias the valve element 2 in the valve opening direction when the armature 4 is positioned upward of the neutral position BP as viewed in the figure, and it acts to bias the valve element 2 in the valve closing direction when the armature 4 is position downward of the neutral position BP.

With the above arrangement, by selectively energizing the closing solenoid 5 and/or the opening solenoid 6 with driving current, the valve element 2 moves between a fully closed position at which the the valve element 2 fully closes the intake port 8, and a fully open position at which the lift of the valve element 2 is the maximum.

Figure 2:
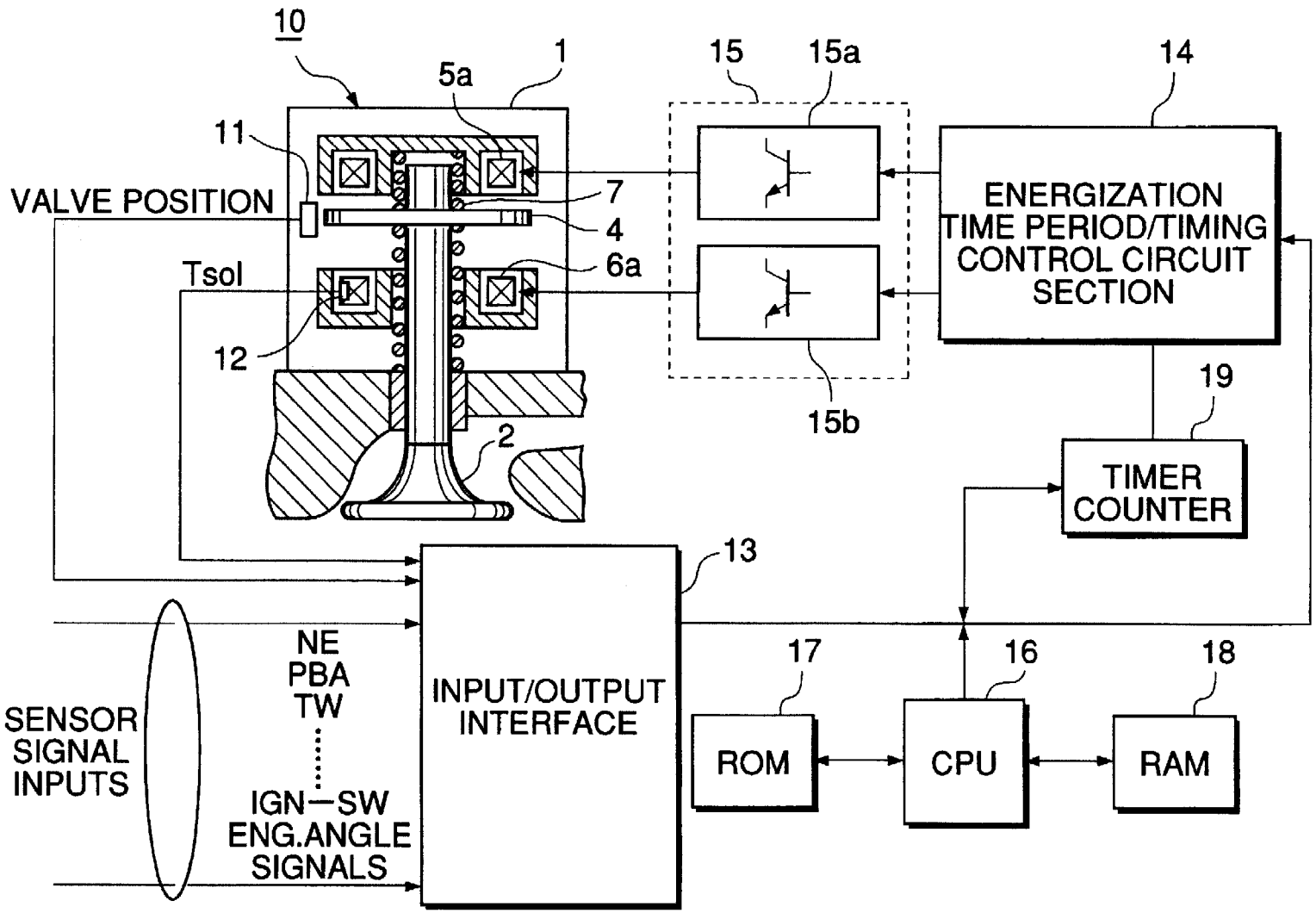
FIG. 2 is a schematic diagram showing the whole arrangement of the control system according to the embodiment.

FIG. 2 schematically shows the whole arrangement of the control system according to the embodiment, incorporating the above described electromagnetic valve 10. In the figure, the valve driving section 1 of the electromagnetic valve 10 is provided with a position sensor 11 for detecting the position of the armature 4, and a temperature sensor 12 for detecting the temperature Tsol of the opening solenoid 6, signals indicative of the detected values being supplied via an input/output interface 13 to a CPU (central processing unit) 16 as well as to an energizing time period/timing control circuit section 14. Further connected via the input/output interface 13 to the CPU 16 are other sensors, not shown, for supplying electric signals indicative of various parameters including engine rotational speed NE, intake pipe absolute pressure PBA, engine coolant temperature TW, engine rotational angle, and on/off state of an ignition switch of the engine, not shown, to the CPU 16 and the energizing time period/timing control circuit section 14.

Also connected to the CPU 16 are a ROM 17 storing operational programs, etc. which are executed by the CPU 16, and a RAM 18 for storing data of results of calculations, detected parameter data from the sensors, etc. Further, a timer counter 19 having the function of a timer is connected to the energizing time period/timing control circuit section 14. The timer counter 19 is also connected to the CPU 16 to have its count value set by the CPU 16.

The energizing time period/timing control circuit section 14 is connected to a driver circuit 15, which is comprised of a closing solenoid-driving circuit 15*a* connected to the coil 5*a* of the closing solenoid 5 and an opening solenoid-driving circuit 15*b* connected to the coil 6*a* of the opening solenoid 6. The control circuit section 14 controls supply of electric current to the coils 5*a* and 6*a* to energize or deenergize the same.

Figure 3:
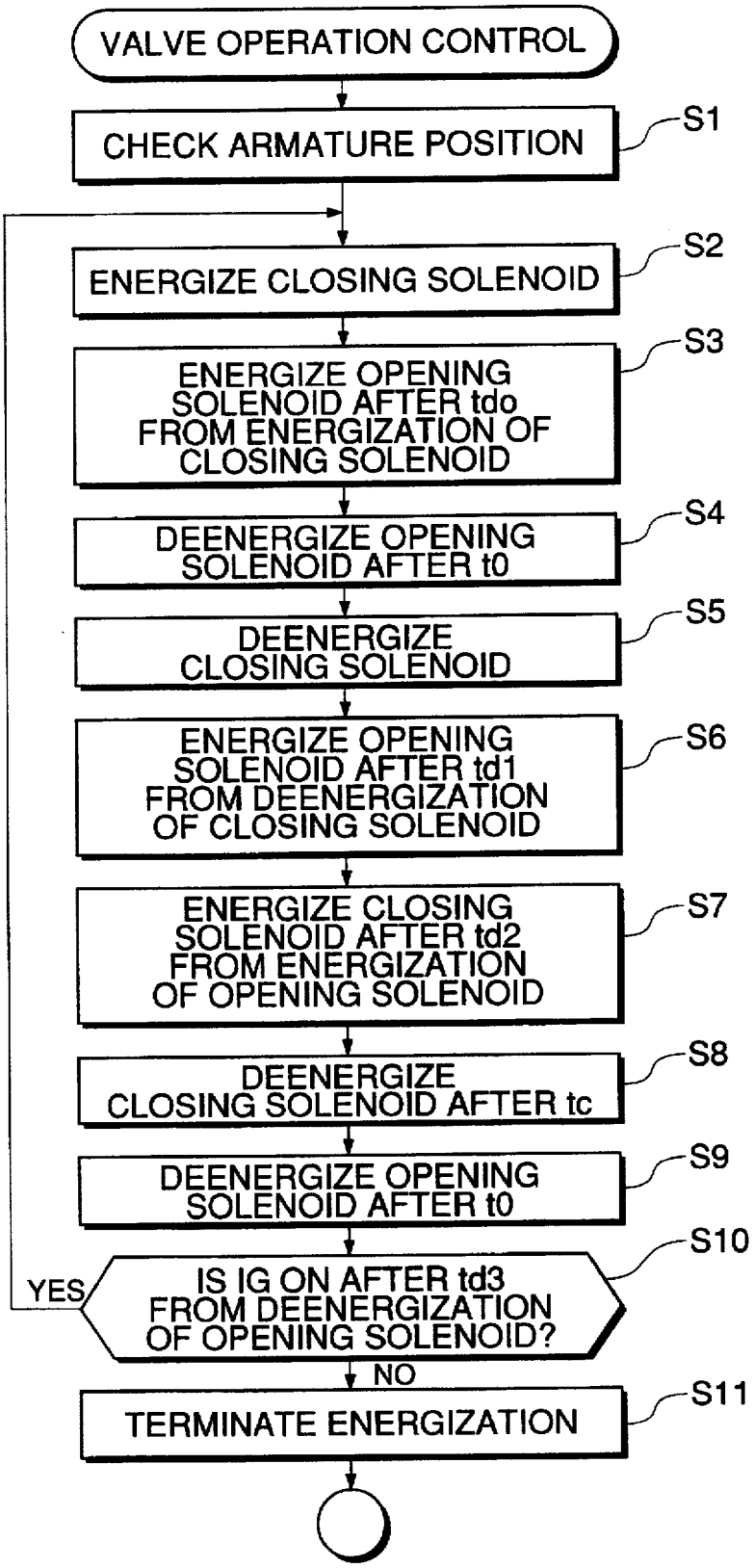
FIG. 3 is a flowchart showing a manner of carrying out valve operation control according to the embodiment.

Next, description will be made of the control operation carried out by the control circuit section 14 with reference to FIGS. 3 and 4.

First, when the ignition switch of the engine is turned on, the position of the armature 4 is detected based on an output from the position sensor 11, at a step S1. Neither of the solenoids 5 and 6 is energized at this time point and accordingly the valve element 2 is positioned in the neutral position BP. Then, energization of the closing solenoid 5 is started at a step S2 (time point t1 in FIG. 4), whereby the valve element 2 starts to be moved in the valve closing direction. When a predetermined acceleration time period td0 has elapsed from the time point t1, the opening solenoid 6 is also energized at a step S3 (time point t2 in FIG. 4) to apply an electromagnetic force to the valve element 2, which acts to drive the same in the valve opening direction, whereby the valve element 2 is decelerated. When a predetermined deceleration time period t0 has elapsed from the time point t2, the valve element 2 almost reaches the fully closed position, and therefore the opening solenoid 6 is deenergized at a step S4 (time point t3). Thereafter, the closing solenoid 5 is continuously energized until a time point t4 at which a predetermined time period Tc elapses from the time point t1, to thereby maintain the valve in the fully closed state.

When the predetermined time period Tc has elapsed, the closing solenoid 5 is deenergized at a step S5 (time point t4) to start a valve opening operation. The opening solenoid 6 is also kept deenergized over a predetermined delay time period td1 from the time point t4 to a time point t5, to thereby drive the valve element 2 only by the driving force of the spring 7. At the time point t5 at which the delay time period td1 has elapsed from the time point t4, the opening solenoid 6 is energized at a step S6. The predetermined delay time period td1 is set to a time period required for the valve element 2 to move from the fully closed position to the neutral position BP only by the driving force of the spring 7. When a predetermined acceleration time period td2 has elapsed from the time point t5, the closing solenoid 5 is also energized at a step S7 (time point t6 in FIG. 4) to apply an electromagnetic force to the valve element 2 to act on the same in the valve closing direction, to decelerate the same. Upon the lapse of a predetermined deceleration time period tc from the time point t6, the valve element 2 almost reaches the fully open position, and therefore the closing solenoid 5 is deenergized at a step S8 (time point t7). Thereafter, the opening solenoid 6 is continuously energized until a time point t8 at which a predetermined time period T0 elapses from the time point t5, to thereby maintain the valve in the fully open state.

When the predetermined time period T0 has elapsed from the time point t5, the opening solenoid 6 is deenergized at a step S9 (time point t8), and when a predetermined delay time td3 has elapsed from the time point t8, it is determined at a step S10 whether or not the ignition switch is on. If it is on, the steps S2 et seq. are executed, whereas if it is off, the energization of the solenoid is terminated. The predetermined delay time period td3 is set to a time period required for the valve element 2 to move from the fully open position to the neutral position BP only by the driving force of the spring 7.

The predetermined energizing time periods TC, T0, tc and t0 as well as the predetermined acceleration time periods td0 and td2 are basically determined based on the engine rotational speed NE and the intake pipe absolute pressure PBA, and corrected according to the engine coolant temperature TW and the solenoid temperature Tsol. These time periods are calculated by the CPU 16 and set to the timer counter 19.

According to the embodiment described above, to cause the valve element 2 to start its valve opening operation from the fully closed position, the closing solenoid 5 is deenergized, and when the predetermined delay time period td1 has elapsed from the start of deenergization of the closing solenoid 5, the opening solenoid 6 is energized. Conversely, to cause the valve element 2 to start its valve closing operation from the fully open state, similar control is carried out, to thereby effectively utilize the driving force of the spring.

In the above described embodiment, the predetermined delay time periods td1 and td3 are set to time periods required for the valve element 2 to move from the respective fully closed position and fully open position to the neutral position BP only by the driving force of the spring 7. However, this is not limitative. The predetermined delay time periods td1 and td3 may be set slightly longer than the respective required time periods. In short, the predetermined delay time periods may be set to at least a time period from the time energization of the valve element is terminated in the fully closed or fully open position to the time acceleration of the valve element attributable to the spring becomes almost zero.

As described above, according to the invention, when the valve opening operation of the valve element 2 is to be started from the fully closed position, energization of the closing solenoid is terminated, and energization of the opening solenoid is started when the predetermined time period td1 has elapsed from the termination of energization of the closing solenoid. As a result, the driving force of the spring can be effectively utilized.

On the other hand, when the valve closing operation of the valve element 2 is to be started from the fully open position, energization of the opening solenoid is terminated, and energization of the closing solenoid is started when the predetermined time period td3 has elapsed from the termination of energization of the opening solenoid. As a result, a similar effect to the above can be obtained.

Further, during the predetermined lap time period t0 or tc, over which the valve element 2 moves toward the fully open position or the fully closed position, respectively, the closing and opening solenoids are both energized. As a result, the deceleration control of the valve element can be finely controlled so that the valve element can be more smoothly moved.

What is claimed is:

1. A control system for an electromagnetic valve having a valve element, a pair of solenoids opposed to each other and disposed to drive said valve element in respective directions opposite to each other and between a first extreme position and a second extreme position, and spring means interposed between said solenoids, for biasing said valve element toward a neutral position intermediate between said first and second extreme positions, the control system comprising:

control means for controlling said solenoids in a manner such that when said valve element is to start moving from one of said first and second extreme positions toward the other extreme position, energization of a corresponding one of said solenoids is terminated, and energization of the other solenoid for a first predetermined time period is started when a predetermined delay time period elapses from said termination of said corresponding one solenoid, wherein said control means carries out energization of said corresponding one solenoid over a second time period shorter than said first predetermined time period and within said first predetermined time period.

2. A control system as claimed in claim 1, wherein said predetermined delay time period is set to at least a time period from the time said energization of said corresponding one of said solenoids is terminated to a time when an acceleration of said valve element attributable to said spring means becomes almost zero.

3. A control system for an electromagnetic valve having a valve element, a pair of solenoids opposed to each other and disposed to drive said valve element in respective directions opposite to each other and between a first extreme position and a second extreme position, and spring means interposed between said solenoids, for biasing said valve element toward a neutral position intermediate between said first and second extreme positions, the control system comprising:

control means for controlling said solenoids in a manner such that said solenoids are both energized over a predetermined overlapping time period during movement of said valve element from one of said first and second extreme positions toward the other extreme position, wherein during said movement of said valve element from one extreme position toward the other extreme position, said control means carries out energization of one of said solenoids over a first predetermined time period, and carries out energization of the other solenoid over a second predetermined time period as said predetermined overlapping time period, which is shorter than said first predetermined time period and within said first predetermined time period.

4. A control system as claimed in claim 1, wherein said first and second extreme positions are a fully closed position of said valve element and a fully open position thereof, respectively.

5. A control system as claimed in claim 1, 2 or 4, wherein said electromagnetic valve is an intake valve for opening and closing an intake port of an internal combustion engine.

6. A control system as claimed in claim 1, 2 or 4, wherein said electromagnetic valve is an exhaust valve for opening and closing an exhaust port of an internal combustion engine.

7. A control system for an electromagnetic valve having a valve element, a pair of solenoids opposed to each other and disposed to drive said valve element in respective directions opposite to each other and between a first extreme position and a second extreme position, and spring means interposed between said solenoids, for biasing said valve element toward a neutral position intermediate between said first and second extreme positions, the control system comprising:

control means for controlling said solenoids in a manner such that said solenoids are both energized over a predetermined overlapping time period during movement of said valve element from one of said first and second extreme positions toward the other extreme position, said solenoids being energized to exert forces in opposite directions on said valve element.

8. A control system as claimed in claim 7, wherein during said movement of said valve element from one extreme position toward the other extreme position, said control means carries out energization of one of said solenoids over a first predetermined time period, and carries out energization of the other solenoid over a second predetermined time period as said predetermined overlapping time period, which is shorter than said first predetermined time period and within said first predetermined time period.

9. A control system as claimed in claim 8, wherein said control means starts said energization of the other solenoid upon lapse of a third predetermined time period after said energization of said one solenoid is started.

10. A control system as claimed in claim 7, 8, or 9, wherein said electromagnetic valve is an intake valve for opening and closing an intake port of an internal combustion engine.

11. A control system as claimed in claim 7, 8, or 9, wherein said electromagnetic valve is an exhaust valve for opening and closing an exhaust port of an internal combustion engine.

12. A control system as claimed in claim 10, including operating condition-detecting means for detecting operating conditions of said internal combustion engine, and wherein said first to third predetermined time periods are set according to said operating conditions of said internal combustion engine detected by said operating condition-detecting means.

13. A control system as claimed in claim 11, including operating condition-detecting means for detecting operating conditions of said internal combustion engine, and wherein said first to third predetermined time periods are set according to said operating conditions of said internal combustion engine detected by said operating condition-detecting means.

14. A control system as claimed in claim 3, wherein said control means starts said energization of the other solenoid upon lapse of a third predetermined time period after said energization of said one solenoid is started.

* * * * *